US005160283A

United States Patent [19]

Fry et al.

[11] Patent Number: 5,160,283

[45] Date of Patent: Nov. 3, 1992

[54] TERMINAL POSITIONING ASSURANCE DEVICE

[75] Inventors: Rupert J. Fry, Des Plaines; Gary E. Polgar, Bolingbrook, both of Ill.

[73] Assignee: Molex Incorporated, Lisle, Ill.

[21] Appl. No.: 802,958

[22] Filed: Dec. 4, 1991

[51] Int. Cl.[5] ..... H01R 13/436

[52] U.S. Cl. ..... 439/752

[58] Field of Search ..... 439/465, 467, 595, 752, 439/466, 687, 696

[56] References Cited

U.S. PATENT DOCUMENTS

| | | | |
|---|---|---|---|
| 4,200,350 | 4/1980 | Zimmerman, Jr. | 339/91 |
| 4,408,823 | 10/1983 | Huber | 439/465 |
| 4,596,432 | 6/1986 | Tighe, Jr. | 439/466 |
| 4,679,874 | 7/1987 | Saijo et al. | 439/595 |
| 4,705,337 | 11/1987 | Maeda | 439/595 |
| 4,711,508 | 12/1987 | Sueyoshi | 439/595 |
| 4,867,712 | 9/1989 | Kato et al. | 439/752 |
| 4,900,277 | 2/1990 | Inaba et al. | 439/752 |
| 4,946,399 | 8/1990 | Kawashima | 439/752 |
| 4,979,913 | 12/1990 | Aiello et al. | 439/596 |

*Primary Examiner*—Gary F. Paumen
*Attorney, Agent, or Firm*—Stephen Z. Weiss

[57] ABSTRACT

A terminal positioning assurance device is provided in a terminal retaining electrical connector assembly. The assembly includes at least one terminal having a locking surface on the exterior thereof. An insulative housing has at least one cavity in which the terminal is received. A window is provided in the housing to afford access to the locking surface on the terminal. A locking member has a locking portion for projecting through the window into engagement with the locking surface on the terminal to retain the terminal in the cavity. The locking member is separate and independent of the housing and includes complementary interengaging pivot surfaces between the housing and the locking member for pivoting the locking member between an opened position and a closed position in which the locking portion projects through the window into engagement with the locking surface on the terminal. Complementary interengaging latches also are provided between the housing and the locking member to hold the locking member in the closed position.

6 Claims, 4 Drawing Sheets

TERMINAL POSITIONING ASSURANCE DEVICE

FIELD OF THE INVENTION

This invention generally relates to the art of electrical connectors and, particularly, to an electrical connector which includes a device for assuring that the terminals are properly positioned and locked within the connector.

BACKGROUND OF THE INVENTION

A wide variety of electrical connectors are provided with various means for locking or retaining the terminals of a connector within the connector housing. Often, terminals are inserted into cavities in the housing and mechanisms such as cantilevered spring arms are provided for snapping behind shoulders of the housing. This arrangement locks the terminals in the housing and prevents the terminals from backing out of the housing, such as when pulling stresses are exerted on leads terminated to the terminals.

However, simple insertion of the terminals into the cavities in the connector housing does not assure that the terminals are properly positioned and locked in place. Therefore, a variety of devices have been designed to assure the proper or full positioning of the terminals. Many such devices incorporate a pivoted member integrally molded with the connector housing, as by a living hinge, whereby the member is pivoted from an open position to allow the terminals to be inserted into the housing cavities and a closed position either biasing the terminals toward their fully inserted positions or simply to ensure that the terminals are properly positioned. In other words, if one or more terminals are not fully inserted into their respective cavities, the positioning assurance member cannot be closed. Such pivoted devices have the advantage of being easy to manipulate and being positionally accurate.

Various problems have been encountered with such integrally molded hinged devices. The living hinges must be relatively thin in order to provide ease of pivoting movement, but the thin hinges may break when exposed to excessive stresses. In addition, by molding a positioning assurance device as an integral part of the connector housing, the overall envelope of the connector often is made excessively bulky.

This invention is directed to solving the above problems by providing a terminal positioning assurance device which is independent of the connector housing yet provides the advantages of a pivoted member.

SUMMARY OF THE INVENTION

An object, therefore, of the invention is to provide a new and improved terminal positioning assurance device for an electrical connector.

In the exemplary embodiment of the invention, a terminal retaining electrical connector assembly is disclosed to include at least one terminal having a locking surface on the exterior thereof. An insulative connector housing has at least one cavity in which the terminal is received. A window is provided in the housing to afford access to the locking surface on the terminal. A locking member has a locking portion for projecting through the window into engagement with the locking surface on the terminal to retain the terminal in the cavity.

The invention contemplates that the locking member be separate and independent of the housing. Complementary interengaging pivot means are provided between the housing and the locking member for pivoting the locking member between an opened position and a closed position in which the locking portion projects through the window into engagement with the locking surface on the terminal. Complementary interengaging latch means are provided between the housing and the locking member to hold the locking member in the closed position.

In the preferred embodiment of the invention, the pivot means are located at an edge of the window in the housing. The pivot means include fork means on the locking member embracing the edge of the window.

The latch means are located on the outside of the housing. The latch means include a pair of latch arms on the locking member embracing opposite sides of the housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
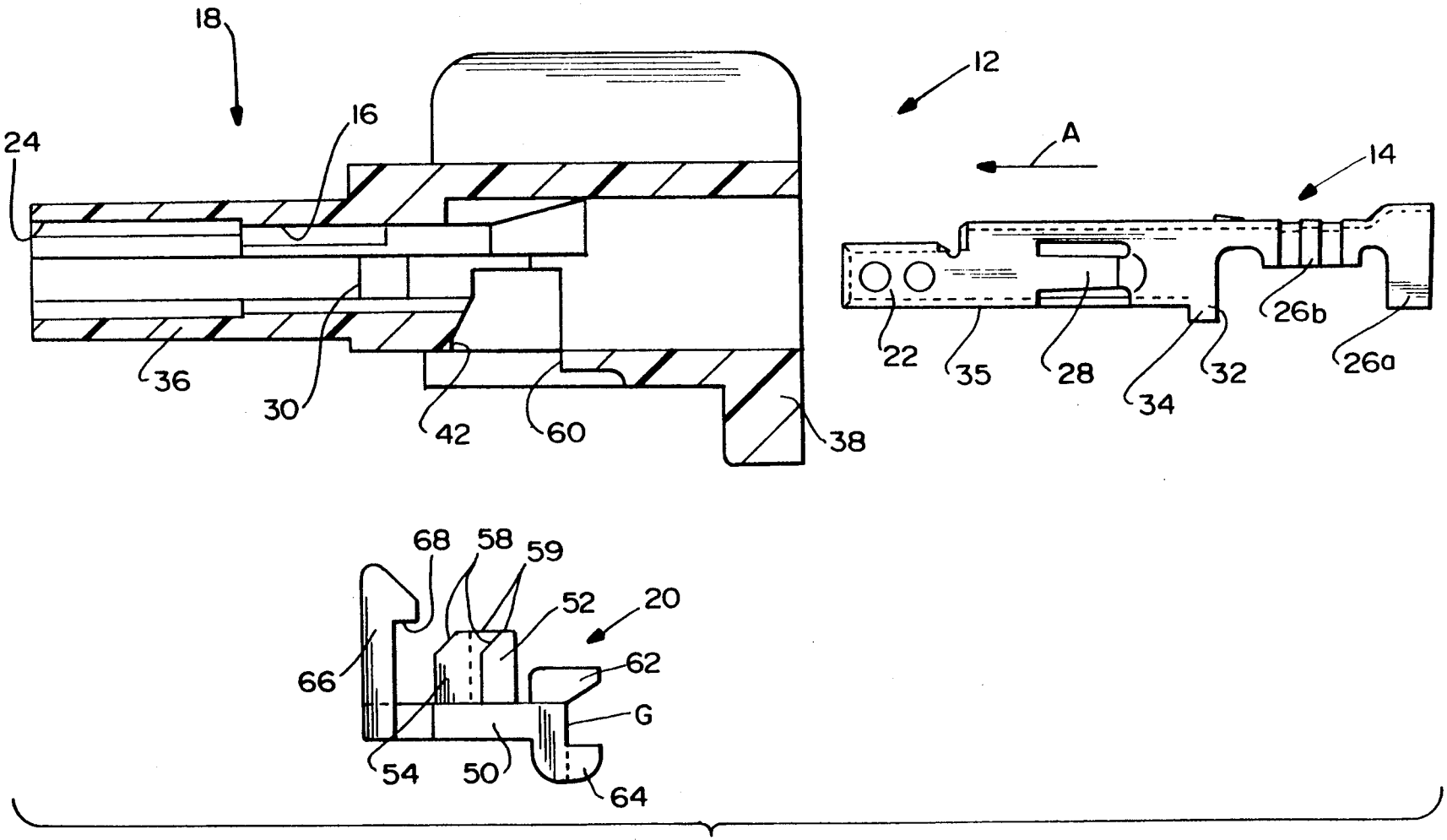
FIG. 1 an exploded elevational view, with the housing in section, of the three components which make up the terminal retaining electrical connector assembly of the invention.
Figure 2:
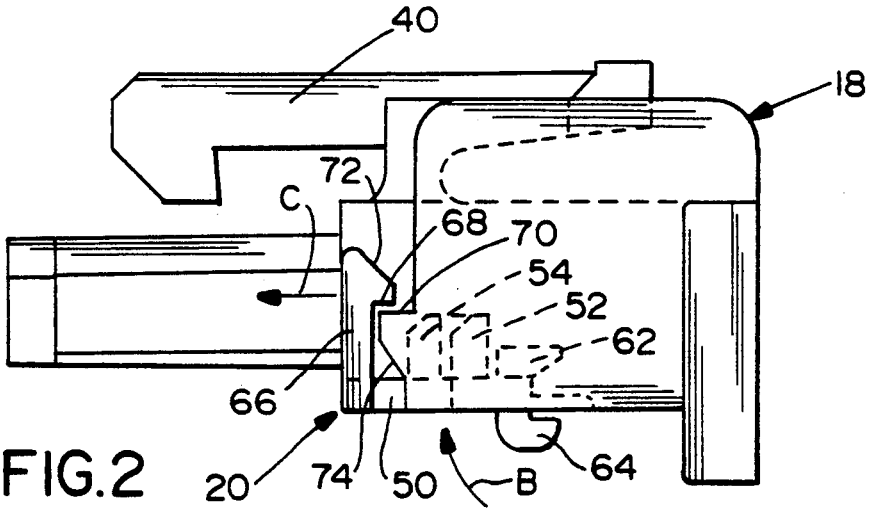
FIG. 2 is a side elevational view of the assembled connector assembly.

Referring to the drawings in greater detail, and first to FIG. 1, a terminal retaining electrical connector assembly, generally designated 12, includes at least one terminal, generally designated 14, insertable into at least one cavity 16 in an insulative housing, generally designated 18. A locking member, generally designated 20, is separate and independent of housing 18 and is provided for assuring that terminal 14 is properly positioned within cavity 16 in housing 18. In the illustrated embodiment of connector assembly 12, there actually are three terminals 14 insertable into three cavities 16 in the connector housing, and locking member 20 is adapted for assuring that all of the terminals are properly positioned. FIG. 2 shows the three components including terminal 14, housing 18 and locking member 20 in fully assembled condition.

Figure 3:
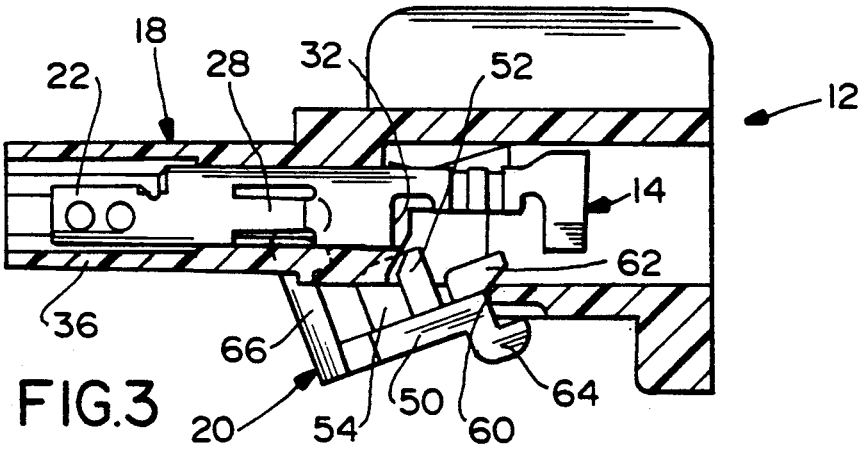
FIG. 3 is a section through the connector housing, with the locking member in its opened position.
Figure 4:
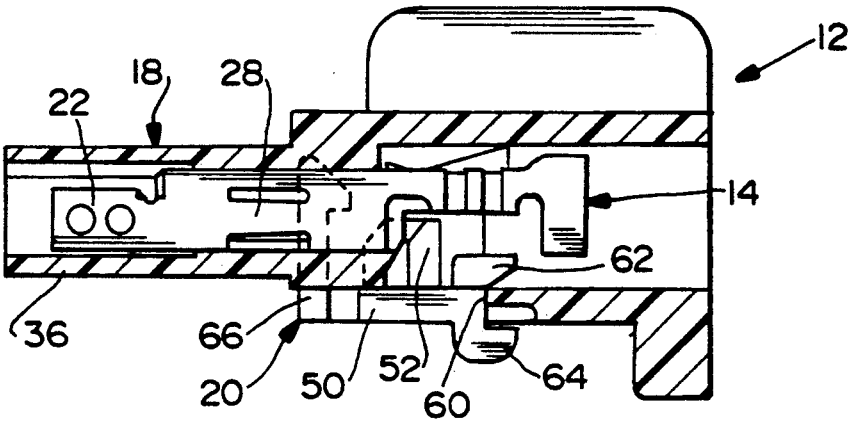
FIG. 4 is a view similar to that of FIG. 3, with the locking member in its closed position.

Generally, FIG. 3 shows the connector assembly in a pre-assembled condition wherein locking member 20 is in its opened position. FIG. 4 shows the connector assembly in fully assembled condition, with locking member 20 in its closed position. Reference will be made back to FIGS. 3 and 4 after the following detailed description of the three components, i.e. terminal 14, housing 18 and locking member 20, which make up the terminal retaining electrical connector assembly 12 of the invention.

More particularly, terminal 14 is of a generally conventional construction and is stamped and formed of sheet metal material. The terminal has a generally cylindrical mating end 22 which communicates with an open mouth 24 of housing cavity 16 for receiving and mating with a complementary terminal pin (not shown), for instance. The rear end of terminal 14 is provided with crimping portions 26*a* and 26*b* or crimping onto the insulation and the conductor core, respectively, of an electrical lead or wire (not shown). a pair of outwardly biased cantilevered latch arms 28 are provided on opposite sides of terminal 14 for snapping behind shoulders 30 molded integrally with opposite sides of housing cavity 16 to retain the terminal within its respective housing cavity when inserted to its full proper position. According to the invention, terminal 14 includes a locking surface or shoulder 32 formed by a tab 34 on the terminal which extends below the bottom surface 35 of the terminal. The terminal is inserted into its respective cavity 16 in housing 18 in the direction of arrow "A" (FIG. 1).

Figure 5:
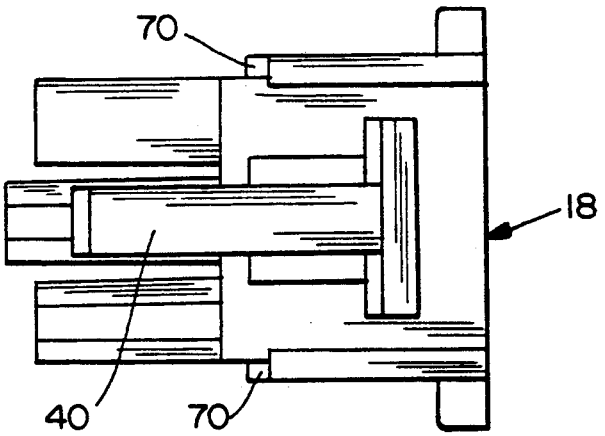
FIG. 5 is a top plan view of the connector housing.
Figure 6:
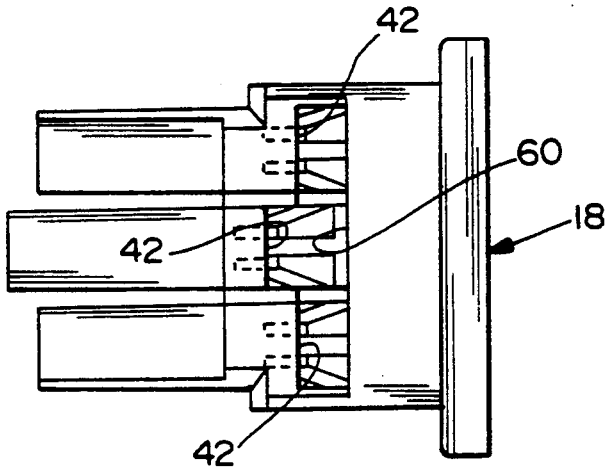
FIG. 6 is a bottom plan view of the connector housing.

Referring to FIGS. 5 and 6 in conjunction with FIGS. 1 and 2, housing 18 includes a mating end 346 and a terminal loading end 38. The mating end is in the form of a plug configuration for insertion into a receptacle portion of a complementary mating connector (not shown). A hooked latch arm 40 is molded integrally with the top of the housing and projects forwardly toward the mating end thereof for engaging an appropriate latch detent on the mating connector. As seen best in FIG. 6, the bottom of housing 18 is provided with a plurality of windows 42 which are located to afford access through the housing to locking surfaces 32 of the three terminals inserted into their respective cavities within the housing. Actually the windows communicate with each other transversely of the housing.

Figure 7:
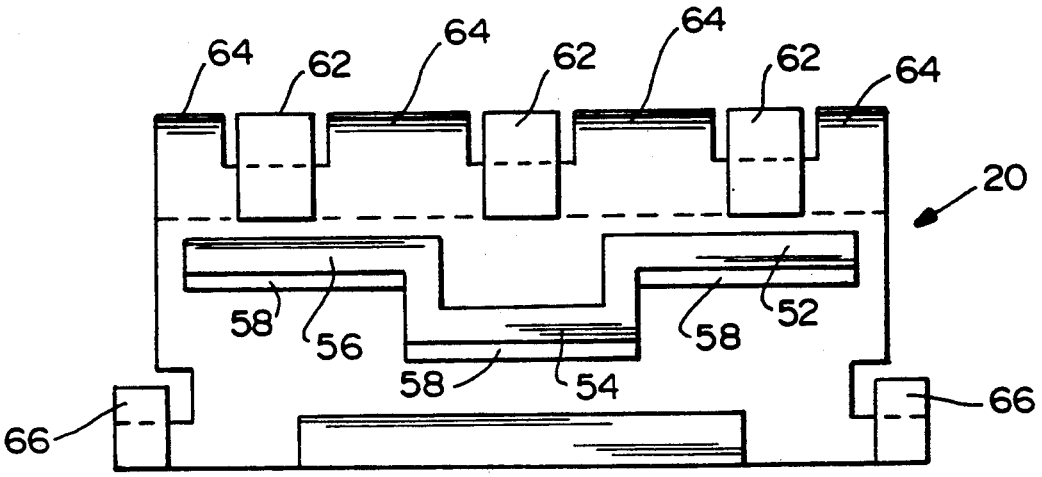
FIG. 7 is a top plan view of the locking member.
Figure 10:
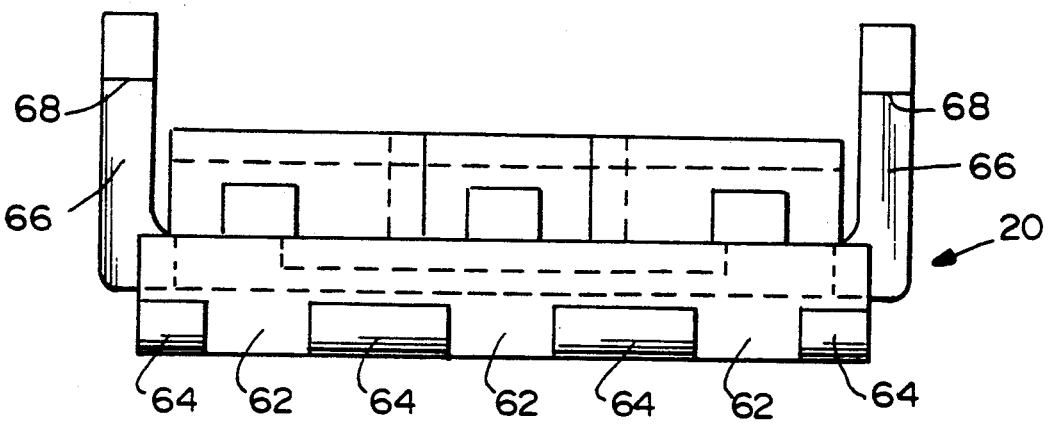
FIG. 10 is an elevational view looking toward the right-hand end of the locking member as depicted in FIG. 1.
Figure 8:
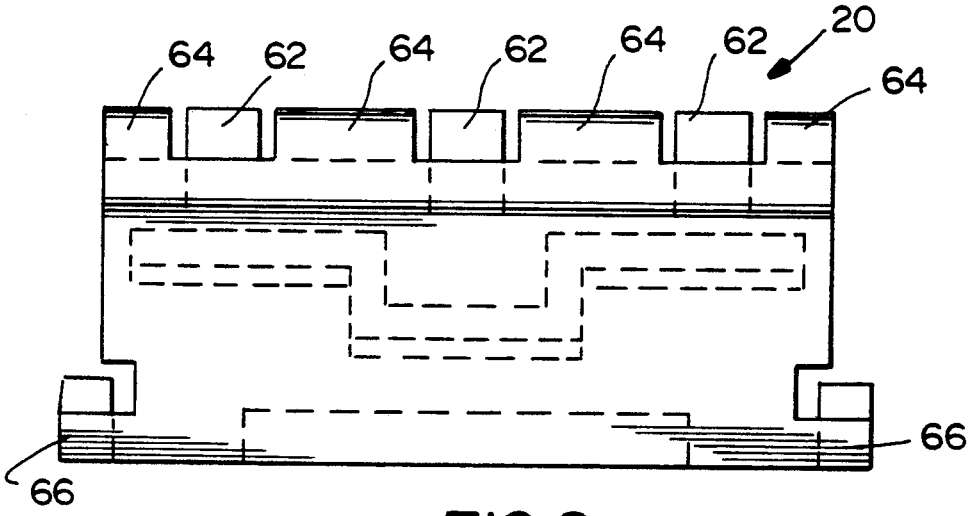
FIG. 8 is a bottom plan view of the locking member.
Figure 9:
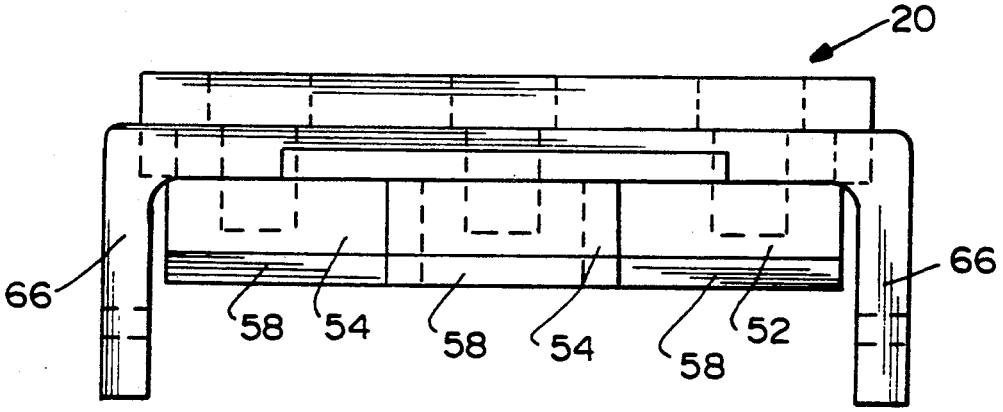
FIG. 9 is an elevational view looking toward the left-hand end of the locking member as depicted in FIG. 1.

Referring to FIGS. 7–10 in conjunction with FIG. 1, locking member 20 includes a base portion 50 which is separate and independent of housing 18. Both the locking member and the housing are unitarily molded of dielectric material such as plastic or the like. The locking member has three locking portions 52, 54 and 56 which are joined as shown in FIG. 7 and which project upwardly through communicating windows 42 in housing 18. The locking portions have chamfered corners 58 as best seen in FIG. 1.

Generally, complementary interengaging pivot means are provided between housing 18 and locking member 20 for pivoting the locking member from an opened position (see FIG. 3) and a closed position (see FIGS. 2 and 4). More particularly, the pivot means is provided by a forward edge 60 of communicating windows 42 and a forked configuration at one end of base portion 50 of the locking member. The forked configuration is provided by upper and lower flanges 62 and 64, respectively, which define a gap "G" (FIG. 1) therebetween. The gap embraces forward edge 60 as best seen in FIGS. 3 and 4 in order to provide a pivot means for moving the locking member from its opened position (FIG. 3) to its closed position (FIG. 4) and vice versa.

Generally, complementary interengaging latch means also are provided between housing 18 and locking member 20 to hold the locking member in its closed position. More particularly, a pair of latch arms 666 project upwardly (as viewed in the drawings) from base portion 50 and terminate in a hook portion 68. Latching ledges 70 (see FIGS. 2 and 5) are provided on opposite sides of housing 18. Latch arms 66 are provided with chamfered surfaces 72 and housing 18 is provided with chamfered surfaces 74 as best seen in FIG. 2. Consequently, when locking member 20 is pivoted upwardly in the direction of arrow "B", chamfered surfaces 72 on latch arms 66 engage chamfered surfaces 74 on the opposite sides of housing 18 to cause the latch arms to move outwardly in the direction of arrow "C" (FIG. 2) until hook portions 68 pass latching ledges 70, whereupon the latch arms will snap back to the locking positions shown in FIG. 2 to hold the locking member in its closed position.

As the locking member (20) pivots about the pivot means defined by flanges 62 and 64 and forward edge 60 of communicating windows 42, the locking portions (52, 54 and 56) will move in front of locking surfaces 32 of terminals 14 to lock the terminals in position. Should one or more of the terminals be substantially but not completely in its fully inserted position while all the remaining terminals are in their fully inserted positions, chamfered surfaces 58 on the respective locking portion (52,54 and/or 56) will engage tab 34 of the particular terminal and bias the terminal further in its insertion direction as indicated by arrow "A" to fully seat the terminal within its respective cavity in the housing. Should one or more of the terminals not be substantially in its fully inserted position the contact edge 59 of the respective locking portion 52, 54 and/or 56 will engage either tab 34 or the bottom surface 35 of the terminal. This interference will prevent the locking member (20) from fully pivoting into the fully locked position signifying us to the person assembling this connector that one or more terminals are not fully inserted.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In a terminal retaining electrical connector assembly which includes at least one terminal having a locking surface on the exterior thereof, an insulative housing having a mating end and a terminal insertion end and at least one cavity in which the terminal is received, a window defined by perimeter edges formed in a surface of the housing providing access to the locking surface on the terminal, and a locking member having a locking portion for projecting through the window into engagement with the locking surface on the terminal to retain the terminal in the cavity, the improvement wherein said locking member having a pivoting end and a locking end and is separate and independent of the housing with complementary interengaging pivot means between the housing and the locking member for pivoting the locking member about its pivoting end between an opened position and a closed position in which the locking portion projects through the window into engagement with the locking surface on the terminal, said pivot means comprising two opposed flanges which receive one of said perimeter edges therebetween, and complementary interengaging latch means between the housing and the locking member to hold the locking member in the closed position, said locking member oriented so that the pivoting end of the locking member is directed toward the housing terminal insertion end and the locking end of the locking member is directed toward the housing mating end.

2. In a terminal retaining electrical connector assembly as set forth in claim 1, wherein said latch means are located on the outside of the housing.

3. In a terminal retaining electrical connector assembly as set forth in claim 2, wherein said latch means include a pair of latch arms on the locking member embracing opposite sides of the housing.

4. In a terminal retaining electrical connector assembly which includes at least one terminal having a locking surface on the exterior thereof, an insulative housing having a mating end and a terminal insertion end and at least one cavity in which the terminal is received, a window defined by perimeter edges formed in a surface of the housing providing access to the locking surface on the terminal, and a locking member having a locking portion for projecting through the window into engagement with the locking surface on the terminal to retain the terminal in the cavity, the improvement wherein said locking member having a pivoting end and a locking end is generally L-shaped and is separate and independent of the housing, including complementary interengaging pivot means between an edge of the window in the housing and a distal end of one of the legs of the general L-shape of the locking member for pivoting the locking member bout its pivoting end between an opened position and a closed position in which the locking portion projects through the window into engagement with the locking surface on the terminal, said pivot means comprising two opposed flanges which receive one of said perimeter edges therebetween, sand complementary interengaging latch means between the housing on the outside of the housing and the other leg of the general L-shape of the locking member to hold the locking member in the closed position, said locking member oriented so that the pivoting end of the locking member is directed toward the housing terminal insertion end and the locking end of the locking member is directed toward the housing mating end.

5. In a terminal retaining electrical connector assembly as set forth in claim 4, wherein said latch means include a pair of said other legs of the L-shaped locking member to define latch arms on the locking member embracing opposite sides of the housing.

6. In a terminal retaining electrical connector assembly as set forth in claim 5, wherein each of said housing and said locking member is unitarily molded of dielectric material.

* * * * *